US010322912B2

(12) United States Patent
Canny et al.

(10) Patent No.: US 10,322,912 B2
(45) Date of Patent: Jun. 18, 2019

(54) CONNECTOR SYSTEM

(71) Applicant: Weatherford U.K. Limited, Leicestershire (GB)

(72) Inventors: Steven Allan Canny, Aberdeenshire (GB); Graeme Foubister, Aberdeenshire (GB); Chika Mba Uduma, Aberdeen (GB)

(73) Assignee: Weatherford U.K. Limited, Loughborough, Leicestershire (GB)

( * ) Notice: Subject to any disclaimer, the term of this patent is extended or adjusted under 35 U.S.C. 154(b) by 0 days.

(21) Appl. No.: 15/570,843

(22) PCT Filed: Jun. 20, 2016

(86) PCT No.: PCT/GB2016/051843

§ 371 (c)(1),
(2) Date: Oct. 31, 2017

(87) PCT Pub. No.: WO2016/203274

PCT Pub. Date: Dec. 22, 2016

(65) Prior Publication Data

US 2018/0148301 A1 May 31, 2018

(30) Foreign Application Priority Data

Jun. 19, 2015 (GB) ..... 1510884.8

(51) Int. Cl.
*E21B 29/12* (2006.01)
*E21B 33/038* (2006.01)
(Continued)

(52) U.S. Cl.
CPC ..... *B66C 1/42* (2013.01); *E21B 19/002* (2013.01); *E21B 29/12* (2013.01); *E21B 33/038* (2013.01);
(Continued)

(58) Field of Classification Search
CPC ..... E21B 29/12; E21B 41/04; E21B 33/038; B66C 1/42
See application file for complete search history.

(56) References Cited

U.S. PATENT DOCUMENTS 4,550,781 A * 11/1985 Kagler, Jr. ..... E21B 29/12 166/340
4,813,496 A * 3/1989 Rohweller ..... E21B 7/128 166/340

(Continued)

OTHER PUBLICATIONS

US Patent Application 990,179 filed Apr. 18, 1911, 5 Pages.

*Primary Examiner* — Matthew R Buck
(74) *Attorney, Agent, or Firm* — Blank Rome, LLP

(57) ABSTRACT

A subsea connector system (10) for providing a connection with a subsea well component comprises a latch assembly (14) defining a through bore and a latch member (18) mounted on the latch assembly. A mandrel (20) extends through said bore of the latch assembly, wherein the mandrel and the latch assembly are axially and rotatably moveable relative to each other in a predefined relative movement sequence to operate the latch member and configure the connector system between connected and disconnected configurations. The connector system also comprises a conveyance connector (22) for providing a connection between a conveyance member (24) and the mandrel such that a conveyance member may permit an axial movement component of the predefined movement sequence. A rotation interface (26) is mounted on one of the mandrel and the latch assembly such that a subsea manipulator may permit a rotational movement component of the predefined relative movement sequence.

25 Claims, 12 Drawing Sheets

(51) Int. Cl.

| | |
|---|---|
| ***E21B 41/04*** | (2006.01) |
| ***B66C 1/42*** | (2006.01) |
| ***E21B 47/10*** | (2012.01) |
| ***E21B 19/00*** | (2006.01) |
| *E21B 33/12* | (2006.01) |

(52) U.S. Cl.
CPC ..... *E21B 47/1025* (2013.01); *E21B 19/008* (2013.01); *E21B 33/12* (2013.01); *E21B 41/04* (2013.01)

(56) References Cited

U.S. PATENT DOCUMENTS

| | | | | |
|---|---|---|---|---|
| 5,146,989 | A * | 9/1992 | Rouse | E21B 19/002 166/339 |
| 5,318,115 | A * | 6/1994 | Rouse | E21B 4/02 166/361 |
| 5,649,385 | A | 7/1997 | Acevedo | |
| 6,029,745 | A * | 2/2000 | Broussard | E21B 31/16 166/298 |
| 7,090,019 | B2 | 8/2006 | Barrow et al. | |
| 8,307,903 | B2 * | 11/2012 | Redlinger | E21B 29/005 166/341 |
| 9,222,328 | B2 * | 12/2015 | Stokes | E21B 23/006 |
| 2005/0145389 | A1 | 7/2005 | Barrow et al. | |
| 2013/0058732 | A1 * | 3/2013 | Anda | B23B 29/03432 408/108 |

* cited by examiner

CONNECTOR SYSTEM

FIELD

The present invention relates to a connector system, for example a subsea connector system.

BACKGROUND

In the oil and gas exploration and production industry many operations require reliable connections to be provided between components or infrastructure. Such connections may be of a permanent or long-term nature, intended to remain part of service infrastructure, such as connections between downhole completion equipment, between lengths of tubular and the like. Other connections may be of a temporary or short-term nature, for example used during the deployment and retrieval of equipment. For example, temporary connections may be required during the deployment and/or retrieval of subsea equipment, such as wellhead equipment. In such temporary connections it can often be a critical requirement to reliably make and break the connection.

Many temporary connectors are known, and many utilise hydraulic power to activate connecting mechanisms. In some instances such hydraulic connectors provide a robust and reliable solution. In some applications, however, for example in deep water subsea applications, hydraulic connector systems may be adversely limited due to the significant ambient pressures involved.

SUMMARY

An aspect or embodiment relates to a subsea connector system for providing a connection with a subsea well component, the connector system comprising:

- a latch assembly defining a through bore;
- a latch member mounted on the latch assembly and being moveable between a latch configuration and an unlatch configuration to facilitate connection and disconnection with a subsea well component;
- a mandrel extending through the through bore of the latch assembly, wherein the mandrel and the latch assembly are axially and rotatably moveable relative to each other in a predefined relative movement sequence to operate the latch member and configure the connector system between connected and disconnected configurations;
- a conveyance connector for providing a connection between a conveyance member and the mandrel such that a conveyance member may permit an axial movement component of the predefined movement sequence; and
- a rotation interface mounted on one of the mandrel and the latch assembly such that a subsea manipulator may permit a rotational movement component of the predefined relative movement sequence.

Thus, a connection with a subsea well component may be made and/or broken by establishing a combination of relative rotational and axial movement between the latch assembly and the mandrel in the predefined relative movement sequence, by the combined use of a conveyance member, providing or permitting axial movement, and a subsea manipulator, providing or permitting rotational movement. Such an arrangement may provide a purely mechanically actuated connector system. As such, an aspect or embodiment may relate to a mechanically actuated subsea connector system. This may minimise or eliminate potential problems associated with, for example, hydraulic systems. Accordingly, the connector system may be less vulnerable to water depth limitations which may be associated with hydraulic systems.

The connection system is arranged to be operated by relative movement between the latch assembly and the mandrel permitted or provided by separate sources of control, specifically axial control via a conveyance member, and rotational control via a subsea manipulator. Such an arrangement may eliminate any requirement for the conveyance member to impart rotation within the connector assembly. This may permit a wider range of conveyance member to be utilised. For example, conveyance members having relatively low torsional stiffness may be utilised, such as very slender members, wire, rope, chain or the like.

The requirement for a conveyance member to provide, for example only provide, relative axial movement within the connector system may permit simplified control of the conveyance member, for example via a surface vessel. In some embodiments this may avoid the necessity to utilise specialised, high cost and infrequently available vessels, and allow more ready use of vessels of opportunity, such as monohull vessels, mobile offshore drilling units and the like.

Also, the requirement for a subsea manipulator to provide, for example only provide, relative rotational movement within the connector may minimise the work requirement of the subsea manipulator, for example by avoiding or minimising the requirement for the subsea manipulator to take on any weight of the connector assembly and/or associated equipment.

By providing different components or portions of the predefined relative movement sequence by separate sources of control (the conveyance member and the subsea manipulator), an additional degree of safety may be established in that a single control source is not entirely responsible, and a more involved or deliberate connection and/or disconnection procedure is required. This may minimise the risk of accidental disconnection, for example.

The conveyance member may comprise an elongate member, such as a slender elongate member. The conveyance member may be spoolable. The conveyance member may comprise a wire, rope, chain, slickline, e-line or the like. The conveyance member may comprise a tubular conveyance member, such as provided by coiled tubing, jointed pipe (e.g., drill pipe) or the like. The conveyance member may be defined by a tubular riser. The conveyance member may be defined by a landing string.

The conveyance member may be configured to support a tensile axial force. Such an arrangement may permit use of gravity to provide axial movement within the connector system. Control of axial movement within the connector system may be provided by controlling a pulling force relative to the connector assembly, against the effect or force of gravity, against a reaction point, for example a point of connection between the connector system and a subsea well component, or the like. In some embodiments the conveyance member may be configured to control axial movement within the connector assembly by varying tension within the conveyance member.

In some embodiments the conveyance member may not be required to support any or significant compressive axial force. Such an arrangement may permit a wider range of conveyance member to be utilised, such as wire, rope or the like. However, in some embodiments the conveyance member may be configured to support a compressive axial force.

The conveyance member and thus axial movement within the connector system may be controlled from a surface vessel. The surface vessel may comprise a heave compensation system. The conveyance member may be controlled by a spool assembly, such as a compensated spool assembly, on a surface vessel.

The conveyance member may be used to control movement of the connector system through water, for example to control deployment and/or retrieval from a surface vessel. In some embodiments the conveyance member may be used to control movement of any well component connected to the connector system.

The conveyance connector may comprise any suitable connector to facilitate connection with the required conveyance member. For example, the conveyance connector may comprise a rope socket, hook, shackle, eyelet, swivel, threaded connector or the like.

The subsea manipulator may comprise a remotely operated vehicle (ROV).

The rotation interface may comprise any suitable interface to facilitate mechanical engagement of a subsea manipulator and to transmit torque to one of the latch assembly and the mandrel. In one embodiment the rotation interface may comprise an engagement arm extending generally radially relative to one of the latch assembly and the mandrel.

In one embodiment the rotation interface may be provided on the mandrel such that a subsea manipulator may move the mandrel relative to the latch assembly.

The latch member may be configurable between an unlatch configuration and a latch configuration to facilitate connection of the connector system with a subsea well component. Relative movement between the mandrel and the latch assembly during the predefined relative movement sequence may operate the latch member to be reconfigured between its latch and unlatch configurations.

When in its latch configuration the latch member may be engaged with the well component. In one embodiment the latch member may engage a latch profile provided on the subsea well component.

When in its unlatch configuration the latch member may be permitted to disengage the well component. Accordingly, the unlatch configuration may comprise a defined state of the latch member in that it is capable of disengaging the subsea well component.

The latch member may engage the well component to prove a preload between the connector system and the subsea well component, for example between the latch assembly and the well component. Such a preload may one or both axially and rotationally secure at least the latch assembly and the well component. Such axial and/or rotational connection or locking between the well component and the latch assembly may permit reaction to axial and/or rotational loadings. This may facilitate axial and/or rotary based procedures or operations to be performed, for example within or through the well component.

In one embodiment the latch member may be positively moved during relative movement between the mandrel and latch assembly. For example, the latch member may be positively moved to be reconfigured into its latch configuration. Such an arrangement may provide a controlled connection with a subsea well component. Further, such an arrangement may permit a preload to be established between the connector system and the subsea well component. In some embodiments the latch member may be supported when in its latch configuration. Accordingly, the latch configuration of the latch member may be achieved by securing or supporting the latch member in engagement with the subsea well component.

The latch member may be positively moved to be reconfigured into its unlatch configuration. Alternatively, the latch member may not be positively moved to be reconfigured into its unlatch configuration. For example, the latch member may be desupported during relative movement between the mandrel and latch assembly such that the latch member is no longer positively held within its latch configuration. Accordingly, the unlatch configuration of the latch member may be achieved by desupporting the latch member.

The mandrel may comprise a drive profile for engaging and operating the latch member and permitting said latch member to be reconfigured between its latch and unlatch configurations during relative movement between the mandrel and the latch assembly. The drive profile may be arranged to move the latch member from its unlatch to latch configurations, and optionally support the latch member in its latch configuration. The drive profile may be arranged to desupport the latch member to permit said latch member to be reconfigured from its latch configuration to its unlatch configuration.

The drive profile may define an axial surface arranged to engage the latch member in an axial direction. The drive surface may be provided by a load shoulder on the mandrel. The load shoulder may be defined by an upset portion on the mandrel. The load shoulder may be provided by an interface or connection between different components of the mandrel.

In some embodiments the latch member may be reconfigured between its latch and unlatch configurations during both relative axial and rotational movement components of the predefined relative movement sequence.

Alternatively, the latch member may be reconfigured between its latch and unlatch configurations during one of the axial or rotational movement components of the predefined relative movement sequence. In some embodiments one of the axial and rotational components of the relative movement sequence may reconfigure the latch member, and the other of the axial and rotational components of the relative movement sequence may provide a secondary function. The secondary function may comprise a securing function to secure the latch member in either its latch or unlatch configuration.

Relative axial movement between the latch assembly and the mandrel may be provided along a primary axis. Relative rotation between the latch assembly and the mandrel may be achieved around the primary axis.

In one embodiment the rotational component of the predefined relative movement sequence may be limited, for example physically limited, to prevent over-rotation. In one embodiment, the axial component of the predefined relative movement sequence may be limited, for example physically limited.

At least one rotational component of the predefined relative movement sequence may provide an enhancement of a connection force applied by the latch member and the subsea well component. For example, at least one rotational component may provide a cam or wedge effect.

The connector system may be reconfigurable from its disconnected configuration to its connected configuration during relative movement of the mandrel and latch assembly in a first direction in the predefined relative movement sequence. The connector system may be reconfigurable from its connected configuration to its disconnected configuration during relative movement of the mandrel and latch assembly in a reverse second direction in the predefined relative movement sequence.

The mandrel and latch assembly may be moveable relative to each other in the predefined relative movement sequence between first and second relative positions. When in the first relative position the connector system may be arranged in its disconnected configuration. When in the second relative position the connector system may be arranged in is connected configuration.

The predefined relative movement sequence may comprise at least one axial component and at least one rotational component. In one embodiment an axial component must be completed before a rotational component can be initiated, and vice versa.

In one embodiment the predefined relative movement sequence may comprise at least one axial component and multiple, for example two, rotational movement components. The rotational components may be provided in the same or different rotational directions.

In one embodiment the predefined relative movement sequence may comprise a first rotational component followed by an axial component, followed by a second rotational component. The axial component may facilitate reconfiguring of the latch member, for example to selectively support and desupport the latch member. The rotational components may provide a securing function, for example to prevent relative axial movement between the mandrel and the latching assembly which may otherwise reconfigure the latch member.

In one embodiment the predefined relative movement sequence may comprise multiple axial components and multiple rotational components. For example, in one embodiment the predefined relative movement sequence may comprise first and second axial components and first and second rotational components. The first and second rotational and axial components may be interspersed. The first and second rotational movement components may be provided in a common rotational direction. The first and second rotational movement components may be provided in opposing rotational directions. The first and second axial movement components may be provided in a common axial direction. The first and second axial movement components may be provided in opposing axial directions.

In one embodiment relative movement of the mandrel and latch assembly from the first relative position to the second relative position to reconfigure the connector system in its connected configuration may be achieved by the first axial component, followed by the first rotational component, followed by the second axial component, followed by the second rotational component. The first axial component and subsequent first rotational movement may provide movement from an initial running configuration. The second axial component may facilitate reconfiguring of the latch member to its latch configuration. The second rotational component may effectively provide locking of the connector system in its connected configuration. The second rotational component may provide an enhancement of a connection force applied by the latch member and the subsea well component. For example, the second rotational component may provide a cam or wedge effect. Such an arrangement may provide or enhance preloading in the connector system Relative movement of the mandrel and latch assembly from the second relative position to the first relative position to configure the connector system to its disconnected configuration may be achieved by reverse movement. That is, initially establishing the reverse second rotational component to effectively unlock the connector system (and release at least a portion of any preload), followed by the reverse second axial component to reconfigure the latch member to its unlatch configuration, and then the reverse first rotational component and reverse first axial component.

When the mandrel and latch assembly are arranged in their first relative position the latch assembly may be suspended from the mandrel. In such an arrangement during reconfiguring of the connector system from its disconnected configuration to its connected configuration the first axial component of the predefined relative movement sequence may be provided by downward movement of the mandrel relative to the latch assembly. This arrangement may be achieved by supporting the latch assembly on the subsea well component.

Thus, in one embodiment the operational sequence to provide a connection with a subsea well component may comprise:

- landing the latch assembly on the well component;
- reducing tension in an associated conveyance member to permit the mandrel to move axially downward relative to the latch assembly;
- rotating one of the mandrel and the latch assembly using a subsea manipulator;
- applying or increasing tension in the conveyance member to move or lift the mandrel axially relative to the latching assembly and reconfigure the latch member to its latch configuration; and
- further rotating one of the mandrel and the latch assembly using the subsea manipulator to secure the connector system within its connected configuration.

The operational sequence may comprise applying or increasing tension in the conveyance member to move the mandrel axially relative to the latching assembly to initially engage the latch member with the well component, and then increasing (e.g., further increasing) tension in the conveyance member to establish a preload between the connector system and the well component. In this manner the initial engagement of the latch member may provide an adequate axial load reaction point to permit tension in the conveyance member to be further increased without causing separation between the connector system and the well component.

In one embodiment the operational sequence to break an existing connection with a subsea well component may comprise:

- rotating one of the mandrel and the latch assembly using the subsea manipulator;
- lowering the mandrel relative to the latch assembly using the conveyance member to permit the latch member to be configured in its unlatch configuration;
- further rotating one of the mandrel and the latch assembly; and
- lifting the mandrel using the conveyance member until the mandrel picks up the latch assembly from the well component.

The connector system may comprise an interface assembly provided between the latch assembly and the mandrel. The interface assembly may prescribe the predefined relative movement sequence between the mandrel and the latch assembly. That is, the interface assembly may only permit relative movement between the latch assembly and mandrel in the predefined relative movement sequence.

The interface assembly may comprise a track arrangement provided on one of the latch assembly and the mandrel, and a dog arrangement provided in the other of the latch assembly and the mandrel. Interaction of the dog arrangement with the track arrangement may provide or dictate the predefined movement sequence between the mandrel and the latch assembly.

In one embodiment the track arrangement may be provided on the latch assembly, for example provided within the through bore of the latch assembly, and the dog arrangement may be provided on the mandrel.

Alternatively, the track arrangement may be provided on the mandrel, and the dog arrangement may be provided on the latch assembly, for example within the through bore of the latch assembly.

The track arrangement may comprise a track, and the dog arrangement may comprise at a dog configured to be guided or follow along the track.

The track arrangement may comprise multiple track portions defining individual components of the predefined relative movement sequence. The track arrangement may define at least one axially extending track portion and at least one rotationally extending track portion, thus providing axial and rotational components of the predefined relative movement sequence. In one embodiment the track arrangement may comprise first and second axially extending track portions and first and second rotationally extending track portions, for example to facilitate the exemplary operational sequence defined above.

Each track portion may be defined by at least one track edge, wherein a dog of the dog arrangement is configured to move, for example slide, along or relative to said track edge. At least one track portion may be defined by a single track edge. At least one track portion may be defined between opposing track edges, for example to define a slot therebetween.

In some embodiments a track edge may define a load surface, for example to permit a load to be applied between a dog and the at least one track edge. Such an arrangement may be used to provide a preload within the connector system.

In one embodiment the track may define a pocket, wherein a dog of the dog arrangement is received within said pocket when the connector system is in its disconnected configuration. The pocket may be defined in a track edge.

The pocket may provide an axial and rotational connection between the mandrel and the latch assembly such that the latch assembly may be suspended from the mandrel with relative rotation therebetween prevented or restricted.

The pocket may be arranged such that relative axial movement between the mandrel and latch assembly is required to remove the dog from the pocket, followed by relative rotational movement, for example along a track edge, to misalign the dog and the pocket.

The track arrangement may comprise a plurality of tracks, and the dog arrangement may comprise a corresponding plurality of dogs.

The interface assembly may comprise a movement limit arrangement. The movement limit arrangement may comprise at least one rotational movement stop. The movement limit arrangement may comprise at least one axial movement stop.

The connector system may comprise a secondary locking arrangement for providing locking of the latch member in its latch configuration. Thus, the secondary locking arrangement may function to retain the latch member in engagement with the well component.

The secondary locking arrangement may be operable by a subsea manipulator, such as an ROV.

The secondary locking arrangement may comprise at least one locking pin, moveable to engage the latch member when said latch member is in its latch configuration. The at least one locking pin may provide a locking force between the latch member and the latch assembly. The at least one locking pin may be threadedly mounted on the latch assembly, and operable to selectively lock and unlock the latch member my being rotated, for example by a subsea manipulator.

The latch member may be pivotally mounted on the latch assembly and arranged to pivot to selectively engage and disengage a subsea well component. In one embodiment the latch member may be pivotable about a pivot, such as a pivot pin mounted on or supported by the latch assembly. The latch member may be pivotable by rocking about a pin or fulcrum provided on the latch assembly.

The latch member may be generally L-shaped. In one embodiment a first portion of the latch member may be arranged to be engaged by the mandrel, for example a drive profile of the mandrel, and a second portion of the latch member may be arranged to engage a well component.

The connector system may comprise a plurality of latch members, for example circumferentially arranged around the latch assembly.

The connector system may be arranged to provide a connection with a rim structure of a well component. In this arrangement the latch assembly may be arranged to be received over a rim portion of a well component, and the latch member operated to engage a portion of the rim. Engagement of the latch member with the well component in this way may facilitate a preloaded connection or engagement between the latch assembly and the well component to be achieved.

In some embodiment that well component may comprise a subsea well head. The well component may comprise a Xmas tree, such as a production tree, for example a horizontal tree, vertical tree or the like. The well component may comprise a well control barrier, such as a blow out preventer (BOP), subsea test tree (SSTT) or the like The connector system may be configured to support and/or at least partially define a tool assembly. The connector system may comprise a tool assembly connector for providing a connection with a tool assembly. The tool assembly connector may comprise a rigid connector. The tool assembly connector may comprise a flexible interface, such as a compliant interface. In one embodiment the mandrel may be arranged to support a tool assembly. The mandrel may comprise a tool assembly connector.

The connector system may be arranged to support and/or at least partially define a rotary tool assembly. In this regard, the connector system may be capable of being rotationally fixed to a well component, such that a rotational reaction may be established for operation of the rotary tool assembly.

The connector system may be configured to support and/or at least partially define a cutting tool assembly, such as a rotary cutter, mechanical cutter, plasma cutter, abrasive cutter, explosive cutter or the like. In some embodiments the cutter tool assembly may be configured to cut a portion of the well component, for example to permit a portion of the well component connected to the connector system to be retrieved. In one embodiment the well component may comprise a well head, and a cutter tool assembly provided on the connector system may be for cutting one or more tubulars or casings suspended from the wellhead, for example below a mudline. Such an arrangement may permit a well head to be retrieved, for example as part of a well abandonment procedure.

The connector system may be configured to support and/or at least partially define a sealing tool assembly. The sealing tool assembly may be arranged to provide or establish a seal within the well component. The sealing tool assembly may comprise a packer or pack-off seal assembly.

The sealing tool assembly may provide feed through capabilities, for example to permit fluid communication, for example controlled fluid communication, through the seal assembly.

The sealing tool assembly may facilitate one or more operations within the well component.

For example, the well component may form part of a well bore or system, such that the sealing tool assembly may extend into the wellbore or system and establish a seal therein. Such a seal may permit well testing operations, such as pressure testing, for example pressure testing plugs, downhole valves, and the like, extracting samples from the wellbore or system or the like. Such a seal may permit well stimulation procedures to be performed.

The well component may form part of a well control barrier such as a Xmas tree, such that the sealing assembly may extend into the well control barrier and establish a seal therein. Such a seal may permit various operations to be performed, such as pressure testing of various valves and barriers, removing or setting crown plugs and the like.

The sealing tool assembly may be supported by the mandrel. In one embodiment the sealing tool assembly may be at least partially defined by or on the mandrel.

The sealing tool assembly may comprise a sealing arrangement. The sealing arrangement may be configured to sealingly engage the well component, for example an inner surface of the well component. The sealing arrangement may be reconfigurable from a non-sealing configuration to a sealing configuration. Such an arrangement may facilitate initial deployment of the sealing tool assembly. The sealing arrangement may comprise one or more sealing rings.

The sealing arrangement may be reconfigurable from its sealing configuration to its non-sealing configuration. Such an arrangement may facilitate retrieval and/or repositioning of the sealing tool assembly.

The sealing arrangement may be displaceable from its non-sealing configuration to its sealing configuration. In one embodiment the sealing arrangement may be circumferentially expandable to be reconfigured to its sealing configuration. The sealing arrangement may be located on a first support surface defining a first outer diameter or dimension when said sealing arrangement is configured in its non-sealing configuration. The sealing arrangement may be located on a second support surface defining a second, larger outer diameter or dimension when said sealing arrangement is configured in its sealing configuration. In such an arrangement displacement of the sealing arrangement from the first support surface to the second support surface may reconfigure the sealing arrangement from its non-sealing configuration to its sealing configuration.

The first and second support surface may be continuous with each other. A tapering (e.g., ramped, conical etc.) surface may be provided between the first and second support surfaces.

The sealing tool assembly may comprise an actuator. The actuator may be operable to reconfigure the sealing arrangement between its non-sealing and second configurations. The actuator may comprise a piston arrangement, such as a hydraulic piston arrangement.

The connector system may comprise a feed-through arrangement, permitting one or more conduits to extend past the connector system, for example from surface and into the well component, for example to provide operation to the well component, to provide operation to a tool assembly mounted within the well component or the like. The conduit may comprise a hydraulic conduit, pneumatic conduit, electrical conduit, fibre optic conduit or the like.

The mandrel may comprise or define an entry orifice, an exit orifice and a cavity extending therebetween to facilitate passage of a conduit. The entry orifice may be positioned on one side of the latch assembly, and the exit orifice may be positioned on an opposite side of the latch assembly.

One of the entry and exit orifices may be provided in a side wall of the mandrel. One of the entry and exit orifices may be provided in an end of the mandrel. The cavity of the mandrel may be defined by a bore extending at least partially through the mandrel.

The connector system may be operable to provide an initial connection with a subsea well component to permit the well component to be deployed subsea, for example from a vessel. In such an arrangement the connector system may define or form part of a running tool. Once deployed to the required location, the connector system may be operated by a combination of control via the conveyance member and a subsea manipulator to disconnect the connector system from the deployed well component. The deployed well component may comprise any subsea component, and may include a well head, Xmas tree, BOP, SSTT or the like.

The connector system may be operable to provide an initial connection to a well component at a subsea location to permit operations to be performed on or via the well component, such as testing operations, work over operations, intervention operations or the like. Following performance of the required operations the connector system may be disconnected from the subsea well component.

The connector system may be operable to provide an initial connection to a well component at a subsea location to permit the subsea well component to be moved, for example retrieved to surface, repositioned at a different subsea location or the like.

An aspect or embodiment relates to a method for establishing a connection with a subsea well component, comprising:

- positioning a latch assembly relative to the well component;
- establishing relative movement in a predefined relative movement sequence between a mandrel and the latch assembly to operate a latch member mounted on the latch member to move to engage the well component,
- wherein the predefined relative movement sequence comprises at least one axial component provided by a conveyance member connected to the mandrel, and at least one rotational component provided by a subsea manipulator engaged with one of the mandrel and the latch assembly.

The method may comprise activating a secondary locking arrangement to retain the latch member in engagement with the well component. The secondary locking arrangement may be activated or operated by a subsea manipulator.

The method may be performed using the connector system of any other aspect.

An aspect or embodiment relates to a method for breaking a connection with a subsea well component, comprising:

- establishing relative movement in a predefined relative movement sequence between a mandrel and a latch assembly to operate a latch member mounted on the latch member to move to disengage the well component,
- wherein the predefined relative movement sequence comprises at least one axial component provided by a conveyance member connected to the mandrel, and at least one rotational component provided by a subsea manipulator engaged with one of the mandrel and the latch assembly.

An aspect or embodiment relates to a subsea tool system, comprising:

a latch assembly defining a through bore;

a latch member mounted on the latch assembly and being moveable between a latch configuration and an unlatch configuration to facilitate connection and disconnection with a subsea well component;

a mandrel extending through the through bore of the latch assembly, wherein the mandrel and the latch assembly are axially and rotatably moveable relative to each other in a predefined relative movement sequence to operate the latch member and facilitate connection and disconnection with the subsea well component;

a conveyance connector for providing a connection between a conveyance member and the mandrel such that a conveyance member may permit an axial movement portion of the predefined movement sequence;

a rotation interface mounted on one of the mandrel and the latch assembly such that a subsea manipulator may permit a rotational movement portion of the predefined relative movement sequence; and a tool assembly connected to the mandrel.

The tool assembly may be at least partially defined by the mandrel.

The tool assembly may comprise at least one of a rotary tool assembly, a cutting tool assembly, and a sealing tool assembly.

An aspect or embodiment relates to a wellbore casing cutter, comprising a connector system according to any other aspect and a cutting tool assembly connected to the connector system.

An aspect or embodiment relates to a method for cutting casing, for example using a wellbore casing cutter according to any other aspect.

An aspect or embodiment relates to a running tool for deploying and/or retrieving a subsea component. The running tool may comprise a connector system according to any other aspect.

An aspect or embodiment relates to a method for deploying and/or retrieving a subsea component, comprising using a running tool according to any other aspect.

An aspect or embodiment relates to a sealing apparatus, comprising a connector system according to any other aspect and a sealing tool assembly connected to the connector system.

An aspect or embodiment relates to a method for sealing with a well component, for example using a sealing apparatus according to any other aspect.

An aspect or embodiment relates to a connector system for providing a connection with a component, the connector system comprising:

a latch assembly;

a latch member mounted on the latch assembly and being moveable to selectively engage and disengage a component;

a mandrel, wherein the mandrel and the latch assembly are axially and rotatably moveable relative to each other in a predefined relative movement sequence to operate the latch member;

a conveyance connector for providing a connection between a conveyance member and the mandrel such that a conveyance member may permit an axial movement component of the predefined movement sequence; and a rotation interface mounted on one of the mandrel and the latch assembly such that a manipulator may permit a rotational movement component of the predefined relative movement sequence.

It should be understood that the features defined in relation to one aspect may be provided in any combination with any other aspect.

BRIEF DESCRIPTION OF THE DRAWINGS

These and other aspects and embodiments will now be described, by way of example only, with reference to the accompanying drawings, in which.

DETAILED DESCRIPTION OF THE DRAWINGS

Figure 1:
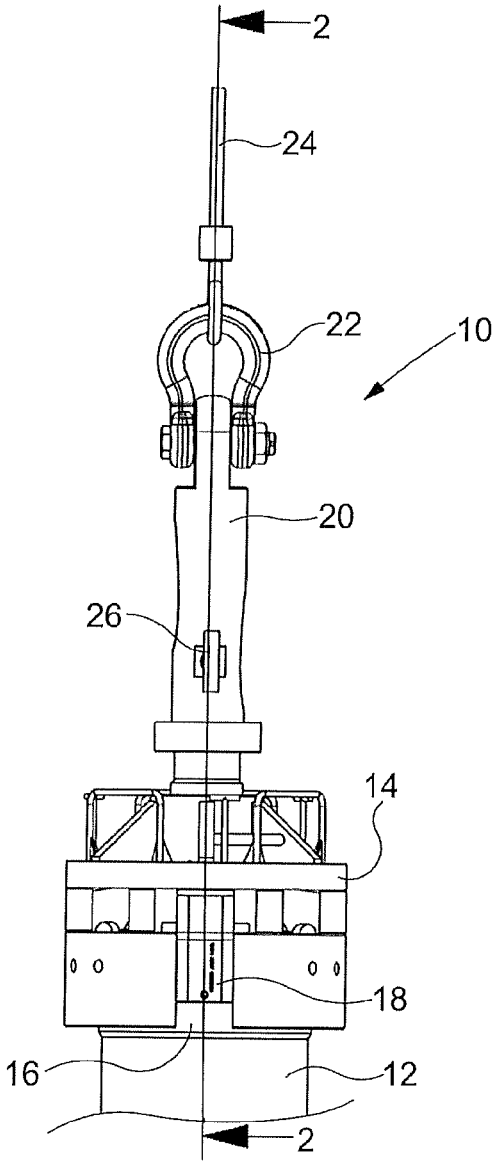
FIG. 1 is a side elevation view of a subsea mechanically actuation connector system, illustrated in a connected state with a well component.

FIG. 1 provides a side elevation view of a subsea connector system, generally identified by reference numeral 10, shown connected with a subsea well component 12. The subsea well component 12 may be any subsea component, such as a well head, Xmas tree or the like. The connector system 10 comprises a latch assembly 14 which mounts over a rim 16 of the well component 12 and includes a plurality of latch members 18 (only one visible in FIG. 1) which pivot to engage the rim 16 of the well component 12 to provide a connection therewith.

The connector system 10 further includes a mandrel 20 which is coupled to the latch assembly 14 and includes a conveyance connector 22 in the form of a shackle which provides connection to a conveyance member 24, specifically wire rope in the present embodiment. The conveyance member 24 extends from a surface vessel (not shown) and is used to trip the connector system 10 to/from the vessel. The conveyance member 24 may also be used to control a relative axial movement between the mandrel 20 and the latch assembly 14.

A pair of rotation arms 26 (only one visible in FIG. 1) are secured to the mandrel 20, and in use permit an ROV (not shown) to engage one or both arms 26 and cause relative rotation between the mandrel 20 and the latch assembly 14.

As will be described in more detail below, a connection with the well component 12 may be made and broken by establishing relative movement between the mandrel 20 and the latch assembly 14 in a predefined relative movement sequence comprising at least one axial component under the control of the conveyance member 24, and at least one rotational component under the control of an ROV engaging one or both arms 26.

Figure 2:
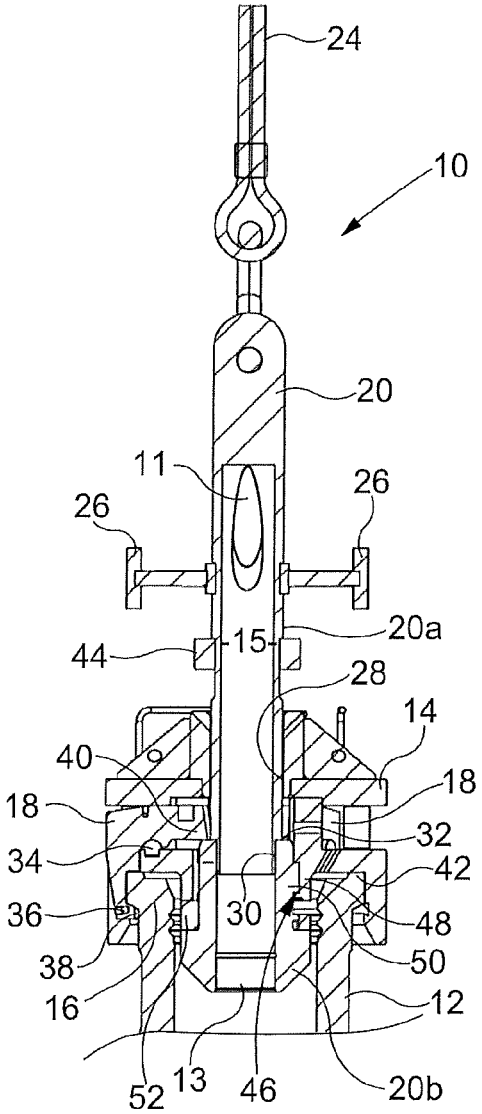
FIG. 2 is a cross-section view of the connector system taken along line 2-2 of FIG. 1.

FIG. 2 provides a cross-sectional view of the connector system 10, taken along line 2-2 of FIG. 1. The mandrel 20 extends through a through bore 28 of the latch assembly 14, and includes an upper mandrel section 20*a* and a lower mandrel section 20*b* secured together by a threaded connection 30, such that the lower mandrel section 20*b* establishes an axial shoulder 32.

The latch members 18 are provided in the form of L-shaped arms and are each pivotally mounted, via fulcrum members 34, on the latch assembly 14, such that the latch members 18 may be moveable in a rocking motion. Each latch member 18 includes a profiled engagement portion 36 which is arranged to engage, generally from below, a corresponding engagement profile 38 on the rim 16 of the well component 12.

The latch members 18 also each comprise a drive portion 40 which is engaged by the axial shoulder 32 of the mandrel 20 such that upward movement of the mandrel 20 relative to the latch assembly 14 drives the latch members 18 to pivot and grip the rim 16. As the engagement portions 36 of the latch members 18 generally grip the rim 16 from below, this may have the effect of pressing the latch assembly 14 and the rim 16 together, for example in region 42, which may provide a preload within the connection. Such a preload may provide a reaction against relative axial and rotational movement between the latch assembly 14 and the well component 12. Downward movement of the mandrel 20 relative to the latch assembly 14 may permit the latch members 18 to be desupported, and thus remove their grip on the rim 16. In this respect a collar 44 is mounted on the mandrel 20 above the latch assembly 14 to limit downward movement of the mandrel 20 relative to the latch assembly 14.

As noted above, relative axial movement of the mandrel 20 in reverse directions relative to the latch assembly 14 may permit operation of the latch members 18. However, as will be described in more detail below, such axial movement is only a component of a required predefined movement sequence, with rotational movement also required to facilitate a complete connection and disconnection operation. In this respect the connector system 10 further comprises an interface arrangement 46 between the mandrel 20 and latch assembly which prescribes the required movement sequence by only permitting relative movement in the predefined sequence. In the present embodiment the interface arrangement 46 includes a track arrangement 48 provided on the latch assembly 14, and a dog assembly 50 provided on the mandrel 20. The form and interaction of the track arrangement 48 and dog assembly 50 will be described in detail below. The interface arrangement 46 also includes a limit ring 52, which, as will be described in more detail below, permits relative axial and rotational movement between the mandrel 20 and latch assembly 14 to be limited.

The mandrel 20 further includes an upper orifice 11 provided in a side wall thereof above the latch assembly 14, and a lower orifice 13 provided in a lower end thereof below the latch assembly 14, with an internal bore 15 extending partially through the mandrel to connect the upper and lower orifices 11, 13. As will be described in further detail below, the orifices 11, 13 and bore 15 provide a duct arrangement to permit one or more conduits to be directed through the mandrel 20, past the latch assembly 14.

Figure 3:
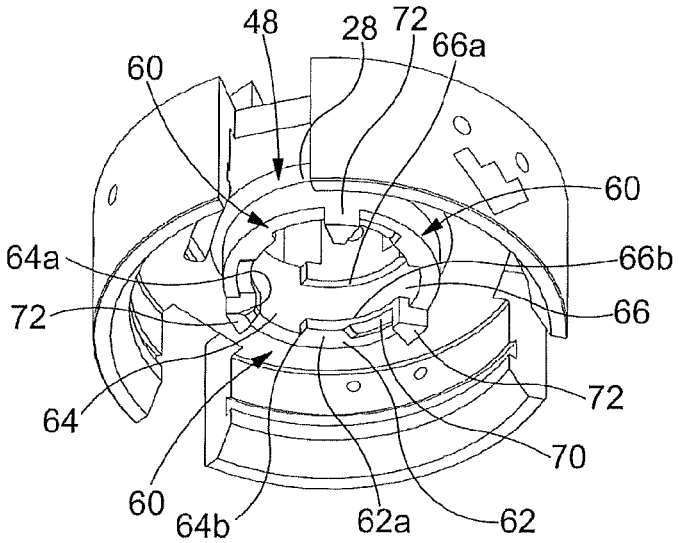
FIG. 3 is a perspective view, from below, of a bonnet member of the connector system of FIG. 1.

FIG. 3 provides a perspective view, from below, of a portion of the latch assembly 14, with the mandrel 20 and latch members 14 removed for clarity. The track arrangement 48 includes three identical tracks 60 arranged circumferentially within the through bore 28 of the latch assembly 14. Each track 60 includes a first track portion 62 which extends generally circumferentially, a second track portion 64 which extends generally axially, and a third track portion 66 which extends generally circumferentially. The first track portion 62 is defined by a single track edge 62. The second track portion 64 is defined between a pair of track edges 64*a*, 64*b* and is thus provided in the form of an axial slot. The third track portion 66 is defined between a pair of track edges 66*a*, 66*b* and is thus provided in the form of a circumferential slot.

The first track portion 62 of each track 60 includes a recess or pocket 70.

The track arrangement 48 also includes three rotation stop members 72.

Figure 4:
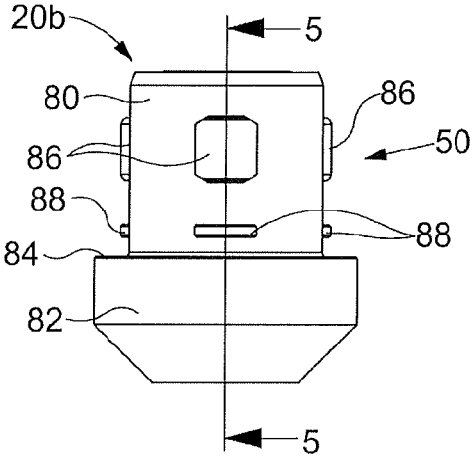
FIG. 4 is a side elevation view of a mandrel portion of the connector system of FIG. 1.
Figure 5:
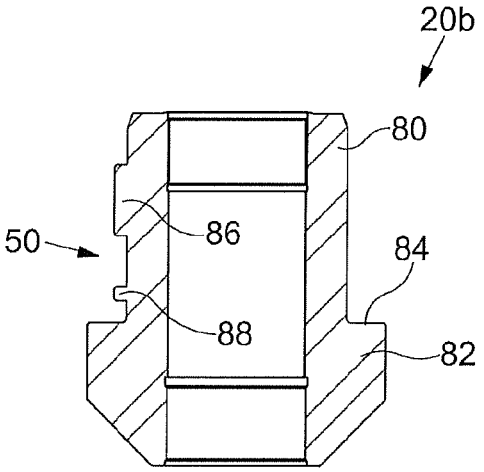
FIG. 5 is a cross-section view of the mandrel portion taken along line 5-5 of FIG. 4.

FIG. 4 provides a side elevation view of the lower mandrel section 20*b*, in isolation, and FIG. 5 is a sectional view, taken along line 5-5 in FIG. 4. The lower mandrel section 20*b* includes or defines the dog assembly 50 and comprises an upper cylindrical portion 80 and a lower enlarged portion 82 with an axial shoulder 84 defined therebetween. The upper cylindrical portion 80 includes three evenly distributed dogs 86 which are sized and arranged to engage the various tracks 60 of the track assembly 48 (FIG. 3). The upper cylindrical portion 80 also includes three evenly distributed locator lugs 88 which function to rotatably secure the limit ring 52 (FIG. 2) to the lower mandrel section 20*b*.

Figure 6:
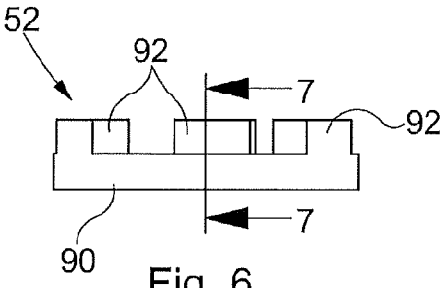
FIG. 6 is a side elevation view of a rotation lock ring of the connector system of FIG. 1.
Figure 7:
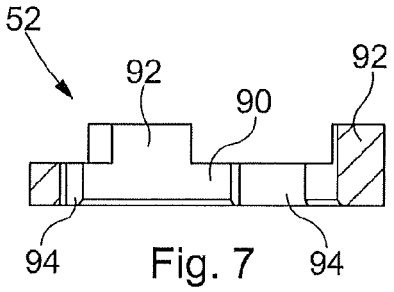
FIG. 7 is a cross-section view of the rotation lock ring taken along line 7-7 of FIG. 6.

A side elevation view of the limit ring 52, in isolation, is shown in FIG. 6, with a sectional view, taken along line 7-7 of FIG. 6 provided in FIG. 7. The limit ring 52 includes a base ring portion 90 and three evenly distributed limit rib members 92 axially extending upwardly from the base ring portion 90. Three locator slots 94 (only 2 visible in FIG. 7) are provided on the inner surface of the base ring portion 90. The limit ring 52 may be mounted over the upper cylindrical portion 80 of the lower mandrel section 20*a* (see, e.g., FIG. 4) with the locator slots 94 of the base ring 90 allowing the limit ring 52 to pass the dogs 86. The limit ring 52 may then rest on the axial shoulder 84, with the locator lugs 88 received within the locator slots 94, thus rotationally securing the limit ring 52 to the lower mandrel section 20*b*.

An operational sequence will now be described in detail with reference to FIGS. 8 to 21.

Figure 8:
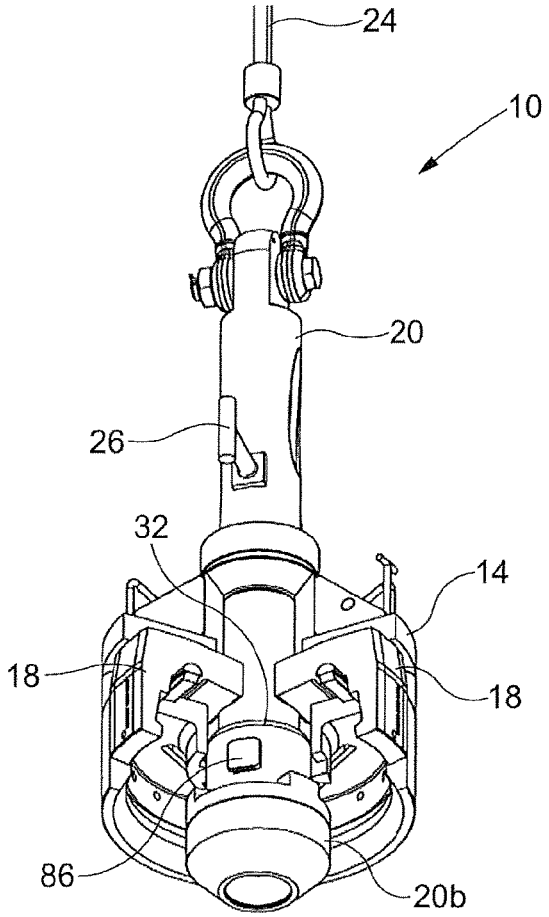
FIGS. 8 to 21 provide an illustration of a sequence for providing a connection between the connector system of FIG. 1 and a well component.
Figure 9:
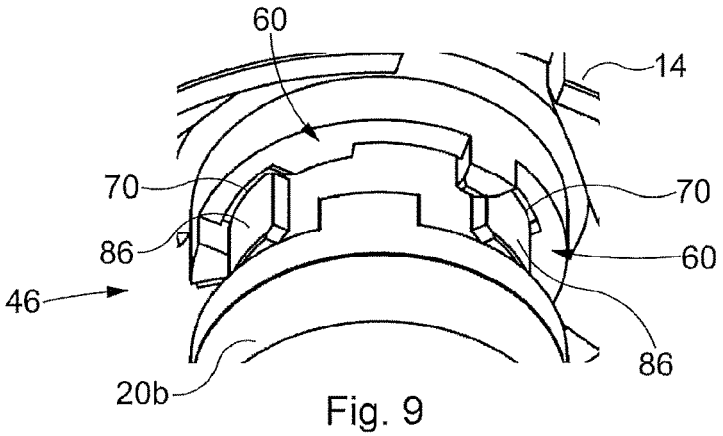

Reference is first made to FIGS. 8 and 9, wherein FIG. 8 is a part cut-away perspective view of the connector system 10 being initially deployed via conveyance member 24, for example from a surface vessel and through a depth of water towards the seabed. FIG. 9 is an enlarged view showing the corresponding configuration of the interface arrangement 46. In this configuration the dogs 86 of the lower mandrel section 20*b* are received within the respective pockets 70 of each track 60, such that the latch assembly 14 is effectively suspended from the mandrel 20, with the weight of the latch assembly 14 carried by the mandrel 20 via the dogs 86. When in this configuration the mandrel 20 and latch assembly 14 are positioned such that the latch members 18 are axially separated from the shoulder 32 on the mandrel 20, and thus are in an unlatch or free configuration.

Figure 10:
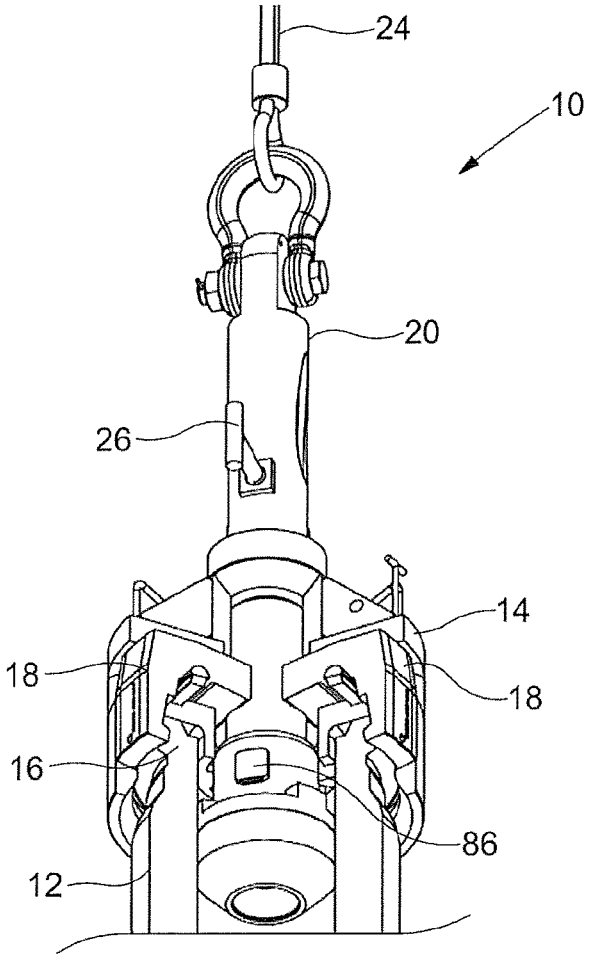
Figure 11:
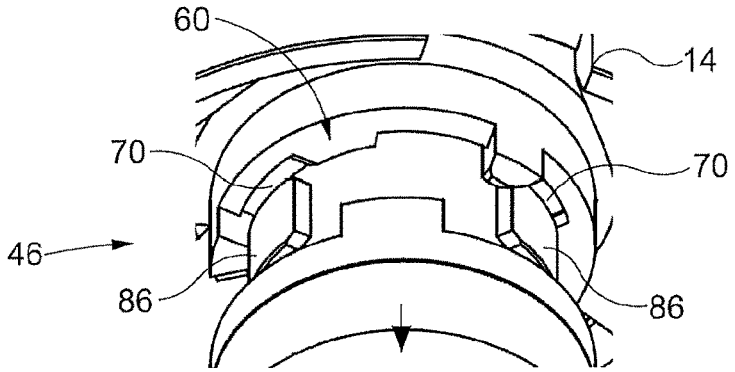

FIG. 10 illustrates the connector system 10 upon initial engagement with the rim 16 of the well component, with FIG. 11 providing an enlarged view of the corresponding configuration of the interface arrangement 46. In this configuration the weight of the latch assembly 14 is transferred to the well component 14, with the conveyance member 24 slightly lowering the mandrel 20 relative to the latch assembly 14, thus moving the dogs 86 out of the respective pockets 70 of the tracks 60.

Figure 12:
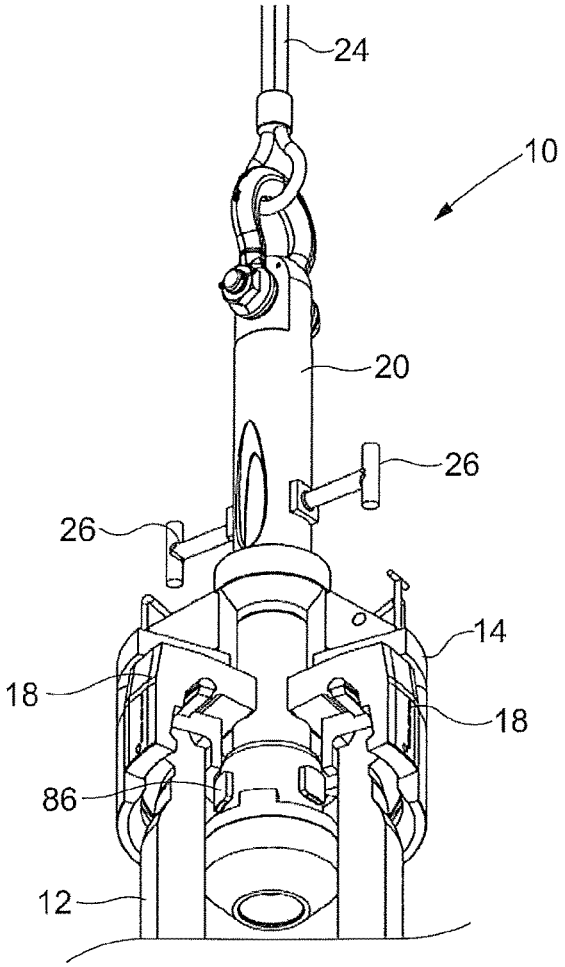
Figure 13:
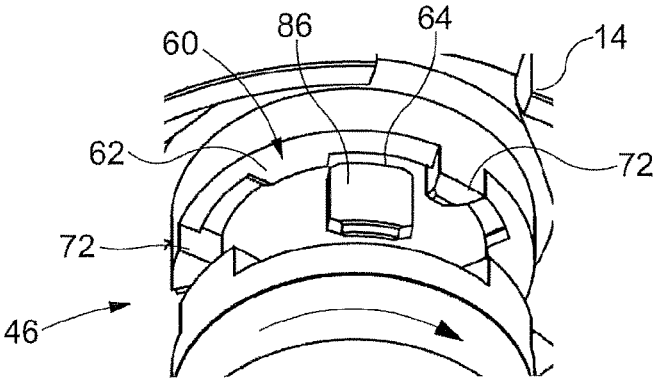

Subsequent to this, as illustrated in FIGS. 12 and 13, the mandrel 20 is rotated, in an anti-clockwise direction (for example by around 60 degrees of rotation), relative to the latch assembly 14, by use of an ROV (not shown) engaging one or both of the arms 26. Such rotation moves the dogs 86 along the respective first track portion 62 of each track 60 until the dogs 86 become aligned with the second track portion 64. In this respect over-rotation is prevented by engagement between the dogs 86 and the rotation stop members 72.

Figure 14:
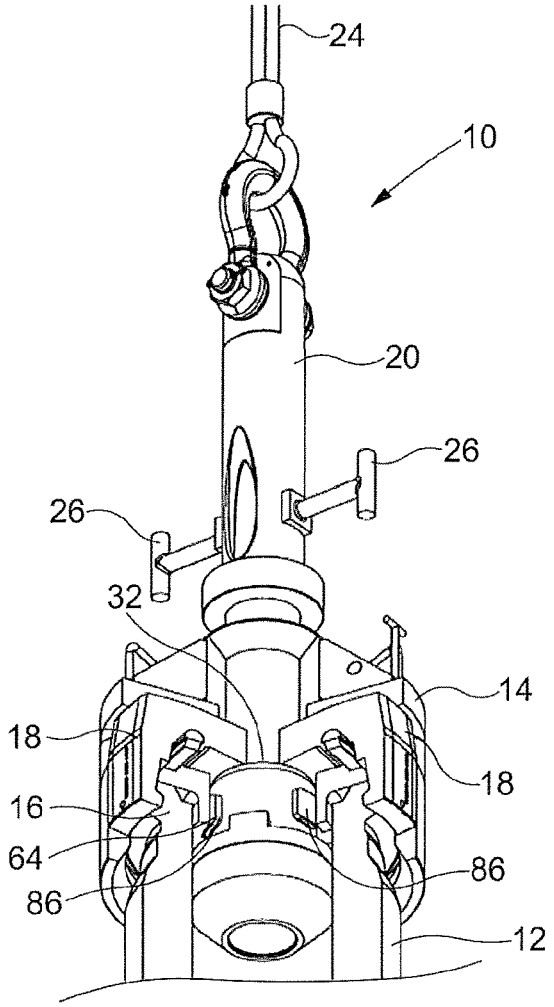
Figure 15:
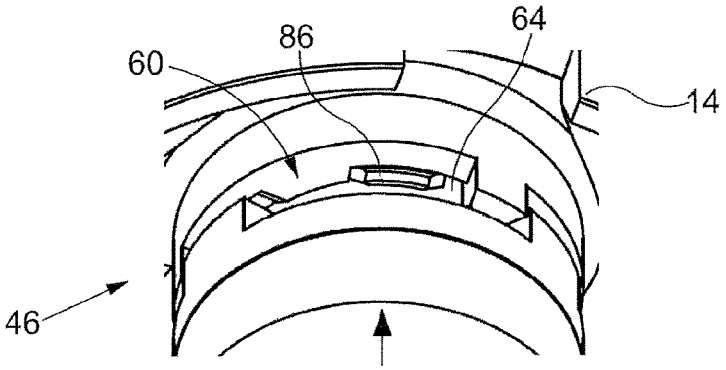

Subsequent to this, as illustrated in FIGS. 14 and 15, the mandrel 20 is lifted axially by the conveyance member 24, moving the dogs 86 into the second track portions 64 of the respective tracks 60, thus engaging the shoulder 32 against the latch members 18 and causing said members 18 to pivot and initially engage the rim 16 of the well component 12.

Figure 16:
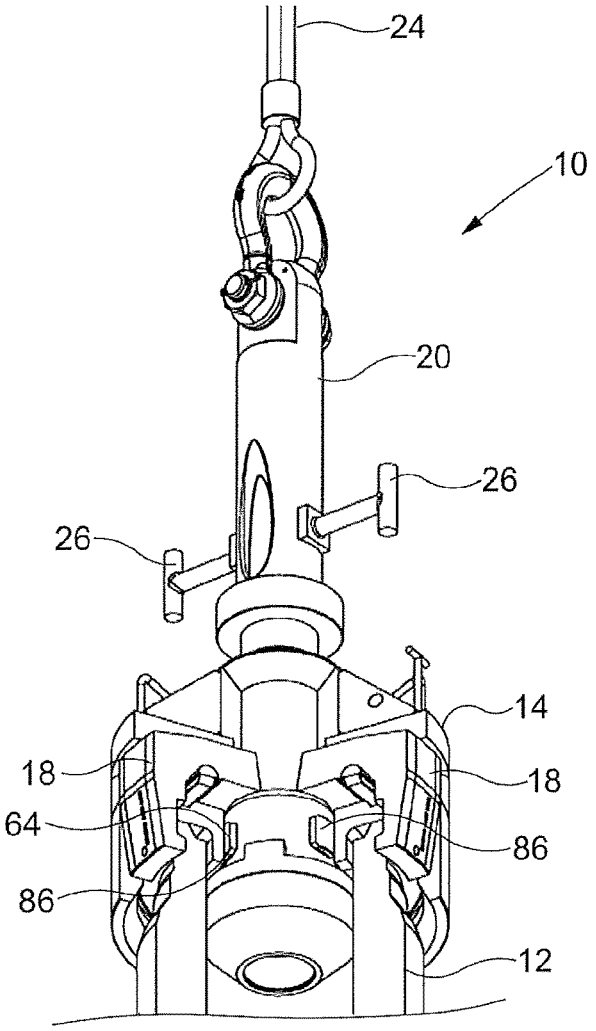
Figure 17:
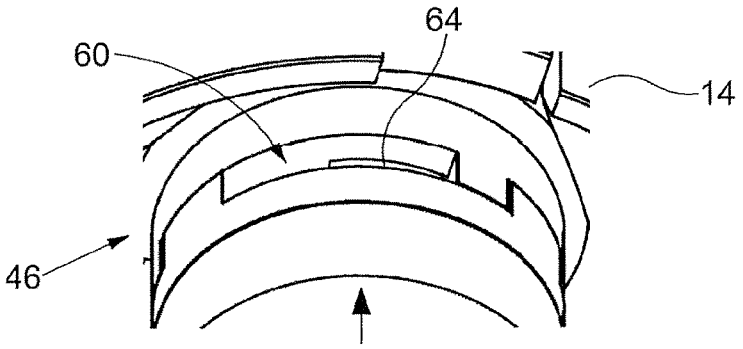

As illustrated in FIGS. 16 and 17, now that initial engagement is made between the latch members 18 and the well component 12, axial tension within the conveyance member 24 can be increased, causing further axial movement of the mandrel 20, increasing the pressing force of the latch members 18 against the rim 16 of the well component 12 and moving the dogs 86 further into the respective second track portions 64, establishing a preload between the latch assembly 14 and the well component 12.

Figure 18:
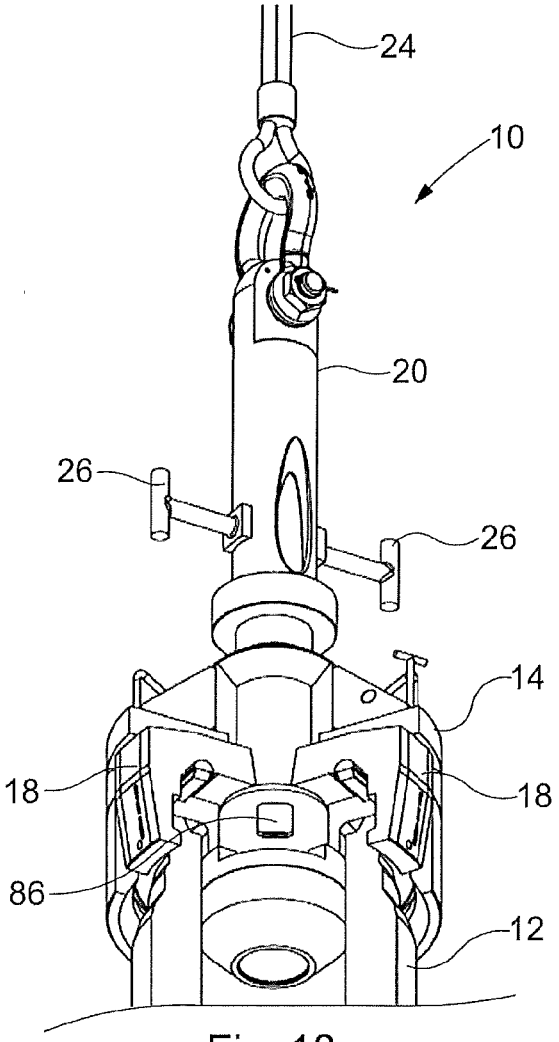
Figure 19:
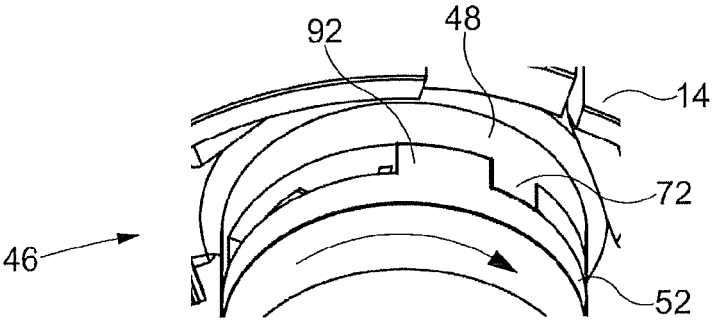
Figure 20:
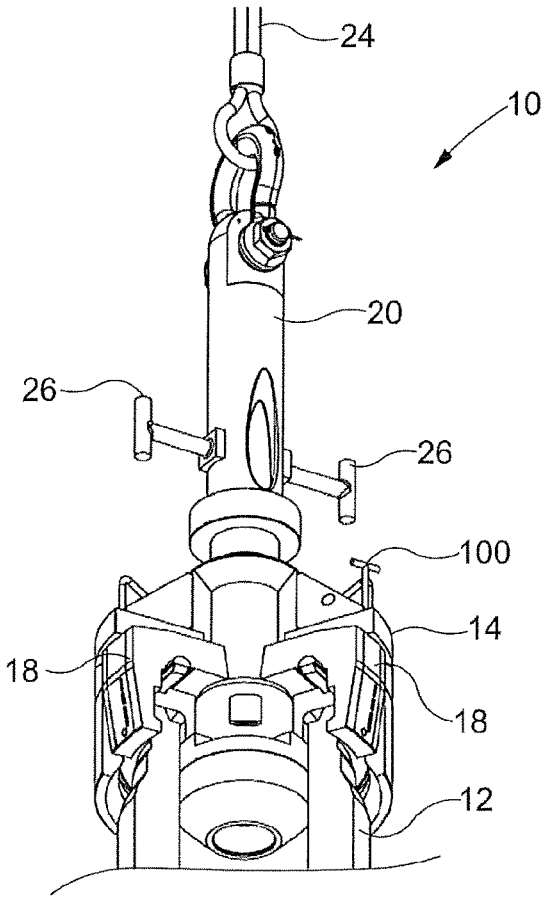

Following this, as illustrated in FIGS. 18 and 19, the mandrel 20 may be again rotated by the ROV (not shown) in an anti-clockwise direction (for example by around 60 degrees of rotation), such that the dogs 86 are now moved into and along the third track portions 66 of the respective adjacent tracks 60 (not visible in FIG. 18 or 20—see FIG. 3). In this respect, upper track edge 66*a* of each third track portion 66 may provide a slight tapering surface, such that an additional axial force between the mandrel 20 and the latch assembly 14 may be created, to provide an additional preload within the connection. As illustrated in FIG. 19, the limit rib members 92 of the limit ring 52 engage the rotation stop members 72 of the track arrangement 48, thus preventing over-rotation.

Figure 21:
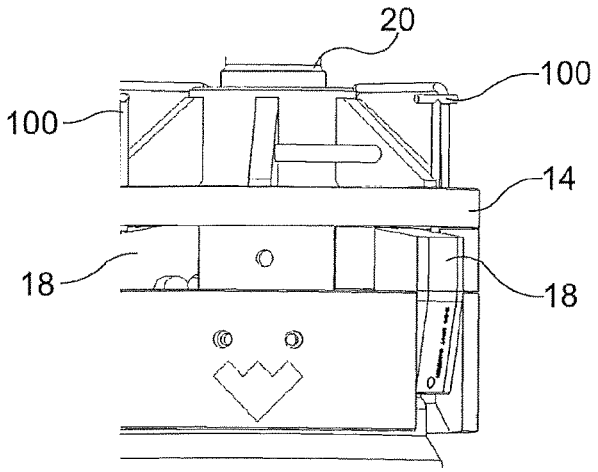

Once in the connected state, a secondary locking system may be operated, as illustrated in FIGS. 20 and 21. In this respect, the latch assembly 14 includes a locking pin 100 associated with each latch member 18. Each locking pin may be driven downwardly, by an ROV (not shown), to engage a top surface of a respective latch members 18.

Thus, a connection with a subsea well component 12 may be made and/or broken by establishing a combination of relative rotational and axial movement between the latch assembly 14 and the mandrel 20 in the predefined relative movement sequence, by the combined use of a conveyance member 24, providing or permitting axial movement, and an ROV (not shown), providing or permitting rotational movement. Such an arrangement may provide a purely mechanically actuated connector system. This may minimise or eliminate potential problems associated with, for example, hydraulic systems, allowing the connector system 10 to have utility in both shallow and ultra-deep applications The requirement for a conveyance member 24 to only provide relative axial movement within the connector system 10 may permit simplified control of the conveyance member 24 via a surface vessel. In some embodiments this may avoid the necessity to utilise specialised, high cost and infrequently available vessels, and allow more ready use of vessels of opportunity, such as monohull vessels, mobile offshore drilling units and the like.

Also, the requirement for an ROV (not shown) to only provide relative rotational movement within the connector system 10 may minimise the work requirement of the ROV, for example by avoiding or minimising the requirement for the ROV to take on any weight of the connector assembly 10 and/or associated equipment.

By providing different components or portions of the predefined relative movement sequence by separate sources of control (the conveyance member 24 and the ROV), an additional degree of safety may be established in that a single control source is not entirely responsible, and a more involved or deliberate connection and/or disconnection procedure is required. This may minimise the risk of accidental disconnection, for example.

The connector system 10 may be used in multiple applications, for example for use in deploying a well component from a vessel, for retrieving a well component to a vessel, for supporting an operation on a well component, or the like. Some example applications will now be described, with reference to FIGS. 22 to 31.

Figure 22:
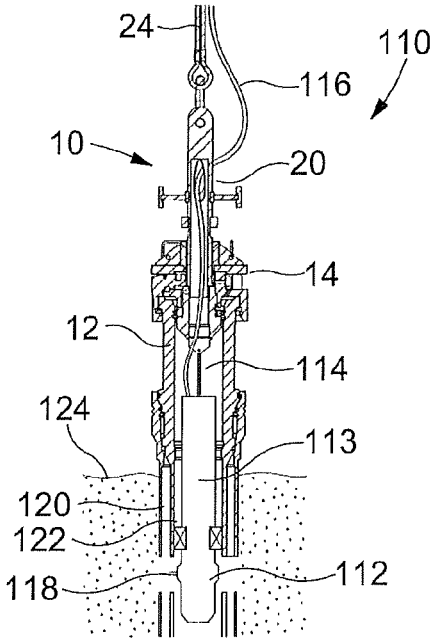
FIGS. 22 to 32 provide exemplary uses of the connection system of FIG. 1.

Referring first to FIG. 22, the connector 10 is illustrated as forming part of a casing cutter system, generally identified by reference numeral 110, with the connector system 10 providing a connection to a wellhead 12. In this embodiment an abrasive cutter tool assembly 112 is suspended from the mandrel 20 via a flexible interface link 114. An umbilical 116 extends from surface and through the mandrel 20 to deliver power, for example hydraulic power to the abrasive cutter tool assembly 112. The cutter tool assembly 112 may generate a radially directed abrasive jet, with rotation of the cutter tool assembly 112 (for example via a mud motor 113) permitting casing strings 120, 122 suspended form the well head 12 to be cut at some location below the mudline 124.

Figure 23:
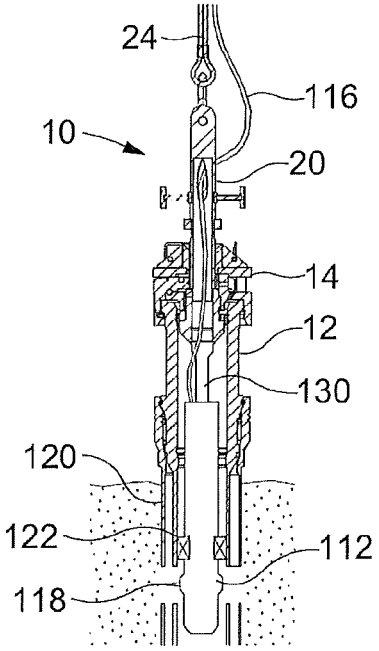

In an alternative embodiment, as shown in FIG. 23, the same abrasive cutter tool assembly 112 may be mounted to the mandrel via a rigid interface link 130.

Figure 24:
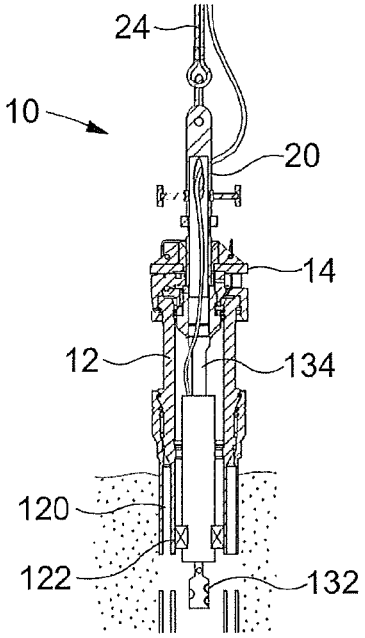
Figure 25:
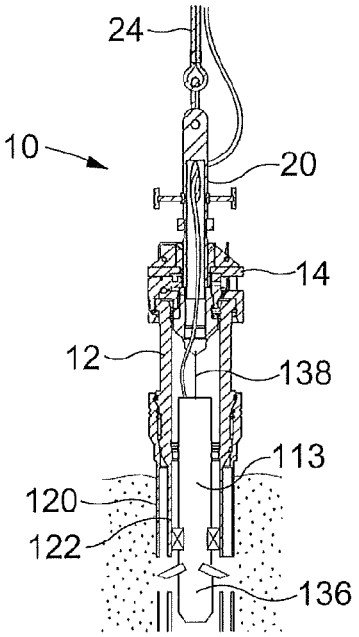
Figure 26:
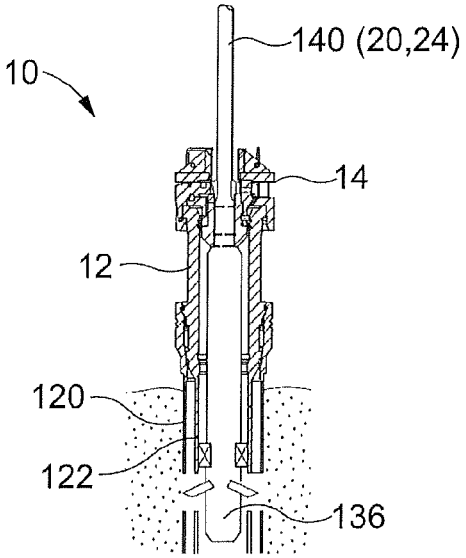

In further alternative embodiments other forms of cutting tool assembly may be provided. For example, FIG. 24 illustrates a perforation gun assembly 132 mounted to the mandrel 20 via a rigid interface 134. FIG. 25 illustrates a mechanical cutting tool assembly 136 mounted on the mandrel 20 via a flexible interface 138 and rotatable by mud motor 113 to permit cutting of the casing strings 120, 122. FIG. 26 illustrates the same cutting tool 136 mounted on drill pipe 140 which extends to surface and also provides the function of conveyance member 24 and a portion of the mandrel 20.

Figure 27:
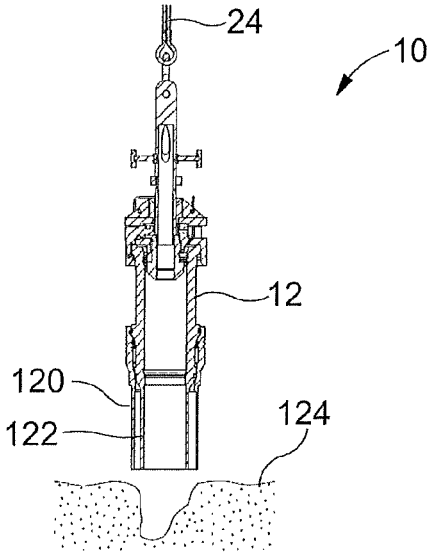

In each of the embodiments in FIGS. 22 to 26, the cutting tool assembly facilitates cutting of casing strings 120, 122 below the mudline 124. This can permit the wellhead 12 and severed sections of casing strings 120, 122 to be retrieved, via the conveyance member 24, as illustrated in FIG. 27. This may form part of a well abandonment operation.

Figure 28:
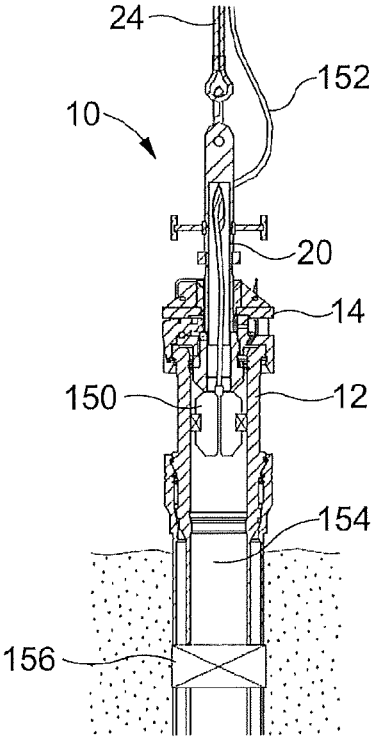

The connector system 10 may also be utilised in well testing operations. For example, as illustrated in FIG. 28, the connector system 10 is connected to a wellhead 12 in the manner described above. In this case a sealing tool assembly 150 in the form of a pack off seal is mounted on and below the mandrel 20, such that a seal may be generated within the wellhead (or lower within the associated wellbore). An umbilical 152 extends from surface and through the mandrel 20, and is coupled to the sealing tool assembly 150. The umbilical 152 may deliver high pressure fluid through the sealing tool assembly 150 and into a wellbore space 154 below the sealing tool assembly 150. This pressurised fluid may be used to pressure test a lower established seal or plug 156, for example which may be used as a well abandon barrier.

In some examples, following the test operation illustrated in FIG. 28, a cutting operation may be performed, such as illustrated in any one of FIGS. 22 to 26, to retrieve the wellhead 12.

Figure 29A:
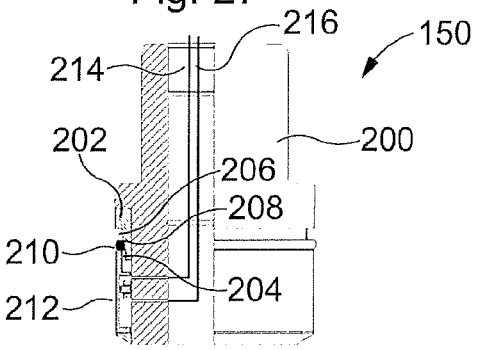
Figure 29B:
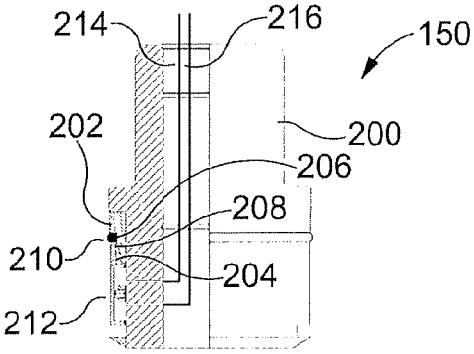

An example of a sealing tool assembly 150 is illustrated in FIGS. 29A and 29B. The sealing tool assembly 150, which is shown in partial cross section, is illustrated in a non-sealing configuration in FIG. 29A, and in a sealing configuration in FIG. 29B.

In this example, the sealing tool assembly 150 includes a body 200 upon which is mounted a seal support 202 which defines a first support surface 204, a second support surface 206 of a larger diameter than the first support surface 204, and a ramp interface 208 therebetween. Although the seal support 202 is illustrated as being separately formed from the body 200, in an alternative arrangement part or all of the seal support 202 may be integrally formed with the body 200. A seal member 210, such as an elastomeric seal member, is mounted on the seal support 202. A hydraulic piston sleeve 212 is mounted on the body 200, and is operable to stroke in opposing axial directions by hydraulic pressure delivered via conduits 214, 216.

When in the non-sealing configuration, as illustrated in FIG. 29A, the seal member 210 is positioned on the first support surface 204 of the seal support 202. When sealing is required, pressure is applied via conduit 214 to cause the piston sleeve 212 to stroke and drive the seal member 210 onto the second support surface 206, as illustrated in FIG. 29B.

In one example the seal member 210 may be secured to the piston sleeve 212, to facilitate reconfiguration of the sealing tool assembly back to its non-sealing configuration.

The sealing tool assembly 150 in the examples shown is provided separately from the mandrel 20 of the connector system. However, in other examples the sealing tool assembly may be provided as part of the connector system 10. For example, the sealing tool assembly 150 may form part of the lower mandrel section 20*b* (see, for example, FIG. 2).

Figure 30:
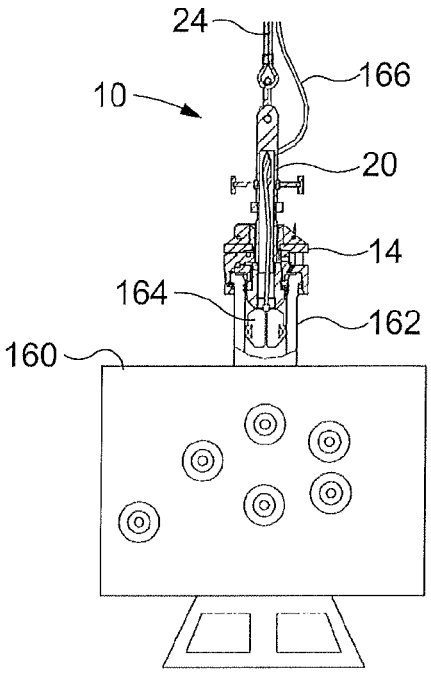

Other applications or uses of the connector system 10 may include deploying tools or equipment. One example is illustrated in FIG. 30, in which the connector system 10 is shown in the deployment of a subsea Xmas tree 160. In this case the Xmas tree 160 includes a re-entry mandrel 162 to which the connector assembly 10 is connected. A pack off seal assembly 164 is mounted below the mandrel 20 of the connector system 10, and in use establishes a seal within the re-entry mandrel 162. An umbilical 166 may extend through the mandrel 20 to provide a high pressure fluid connection to the pack off seal assembly 164. Such high pressure fluid may be communicated through the pack off seal assembly 164 and used in pressure testing within the Xmas tree 160 (for example pressure testing of various pressure barriers within the Xmas tree 160), and/or pressure testing within an associated wellbore.

Figure 31:
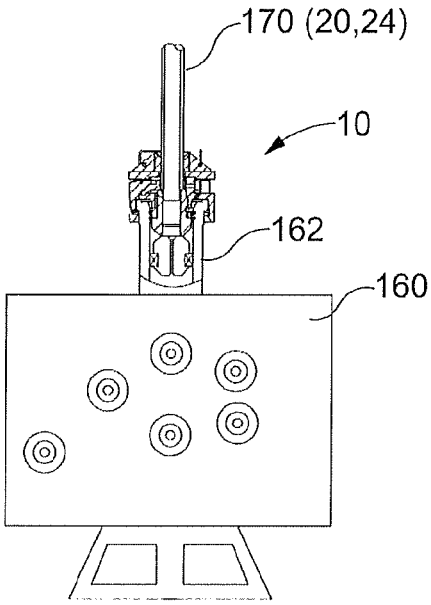

In an alternative embodiment shown in FIG. 31, the connection system 10 may include a tubular riser 170 which provides the function as a conveyance member 24 and also forms part of the mandrel 20. In such an embodiment the tubular riser 170 may deliver pressurised fluid into the Xmas tree 160 for pressure/wellbore testing.

Figure 32:
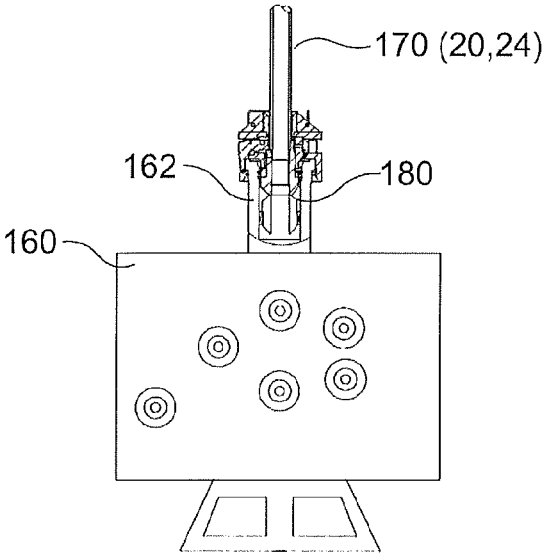

In a further alternative embodiment of FIG. 32, an alternative form of pack off sealing assembly 180 is provided which permits tripping through the tubular riser 170 and the pack of seal assembly 180 to permit crown plugs (not shown) within the Xmas tree 160 to be set and pulled. Such an embodiment may also permit pressure/wellbore testing.

It should be understood that the embodiments described herein are merely exemplary and that various modifications may be made thereto without departing from the scope of the invention.

The invention claimed is:

1. A subsea connector system for providing a connection with a subsea well component, the connector system comprising:

a latch assembly defining a through bore;

a latch member mounted on the latch assembly and being moveable between a latch configuration and an unlatch configuration to facilitate connection and disconnection with the subsea well component;

a mandrel extending through the through bore of the latch assembly, wherein the mandrel and the latch assembly are axially and rotatably moveable relative to each other in a predefined relative movement sequence to operate the latch member and configure the connector system between connected and disconnected configurations;

a conveyance connector for providing a connection between a conveyance member and the mandrel such that the conveyance member is configured to permit an axial movement component of the predefined movement sequence; and a rotation interface provided separately from the conveyance connector and mounted on one of the mandrel and the latch assembly such that a subsea manipulator is configured to permit a rotational movement component of the predefined relative movement sequence, wherein the rotation interface comprises an engagement arm extending generally radially relative to one of the latch assembly and the mandrel, the engagement arm configured to engage the subsea manipulator to permit torque to be transmitted to one of the latch assembly and the mandrel.

2. The subsea connector system according to claim 1, wherein the rotation interface is provided on the mandrel such that the mandrel is moveable by the subsea manipulator relative to the latch assembly.

3. The subsea connector system according to claim 1, wherein the mandrel comprises a drive profile for engaging and operating the latch member and permitting said latch member to be reconfigured between the latch and unlatch configurations during relative movement between the mandrel and the latch assembly.

4. The subsea connector system according to claim 1, wherein at least one rotational movement component of the predefined relative movement sequence increases a connection force applied against the subsea well component.

5. The subsea connector system according to claim 1, wherein the predefined movement sequence comprises a first axial component, a subsequent first rotational component, a subsequent second axial component and a subsequent second rotational component.

6. The subsea connector system according to claim 5, wherein the first axial component and subsequent first rotational component provide movement from an initial running configuration, the second axial component facilitates reconfiguring of the latch member to the latch configuration, and the second rotational component provides locking of the connector system in the connected configuration.

7. The subsea connector system according to claim 6, wherein the second rotational component further provides a connection preload.

8. The subsea connector system according to claim 1, comprising an interface assembly provided between the latch assembly and the mandrel for prescribing the predefined relative movement sequence between the mandrel and the latch assembly, wherein the interface assembly comprises a track arrangement comprising at least one track portion provided on one of the latch assembly and the mandrel, and a dog arrangement comprising at least one dog provided in the other of the latch assembly and the mandrel, wherein interaction of the dog arrangement with the track arrangement provides the predefined movement sequence between the mandrel and the latch assembly.

9. The subsea connector system according to claim 8, wherein the track arrangement defines a pocket, wherein the dog of the dog arrangement is received within said pocket when the connector system is in the disconnected configuration.

10. The subsea connector system according to claim 9, wherein the pocket provides an axial and rotational connection between the mandrel and the latch assembly such that the latch assembly is configured to be suspended from the mandrel with relative rotation therebetween restricted.

11. The subsea connector system according to claim 9, wherein the pocket is arranged such that relative axial movement between the mandrel and latch assembly is required to remove the dog from the pocket, followed by relative rotational movement to misalign the dog and the pocket.

12. The subsea connector system according to claim 1, comprising a secondary locking arrangement for providing locking of the latch member in the latch configuration.

13. The subsea connector system according to claim 1, wherein the latch member is pivotally mounted on the latch assembly and arranged to pivot to selectively engage and disengage the subsea well component.

14. The subsea connector system according to claim 1, comprising a tool assembly connector for providing a connection with a tool assembly, wherein the tool assembly comprises at least one of a rotary tool assembly, a cutting tool assembly, and a sealing tool assembly.

15. The subsea connector system according to claim 1, comprising a sealing tool assembly for providing a seal within the well component, wherein the sealing tool assembly is supported by the mandrel.

16. The subsea connector system according to claim 1, wherein the mandrel defines an entry orifice, an exit orifice and a cavity extending therebetween to facilitate passage of a conduit, wherein the entry orifice is positioned on one side of the latch assembly, and the exit orifice is positioned on an opposite side of the latch assembly.

17. A method for establishing a connection with a subsea well component, comprising:

positioning a latch assembly relative to the well component;

establishing relative movement in a predefined relative movement sequence between a mandrel and the latch assembly to operate a latch member mounted on the latch assembly to move to engage the well component, wherein the predefined relative movement sequence comprises: at least one axial component provided by a conveyance connector for providing a connection between a conveyance member and the mandrel, and at least one rotational component provided by a subsea manipulator engaged with a rotation interface mounted on one of the mandrel and the latch assembly, wherein the rotation interface is separate from the conveyance connector.

18. The method according to claim 17, comprising engaging the subsea manipulator with an engagement arm which extends generally radially relative to one of the latch assembly and the mandrel, and operating the subsea manipulator to rotate one of the latch assembly and the mandrel via the engagement arm.

19. The method according to claim 17, comprising engaging the subsea manipulator with the rotation interface provided on the mandrel and rotating the mandrel with the subsea manipulator.

20. The method according to claim 17, comprising increasing a connection force applied against the subsea well component during the at least one rotational component of the predefined relative movement sequence.

21. The method according to claim 17, wherein the predefined movement sequence comprises a first axial component, a subsequent first rotational component, a subsequent second axial component and a subsequent second rotational component.

22. The method according to claim 21, comprising:

reconfiguring the latch assembly and the mandrel from an initial running configuration during the first axial component and subsequent first rotational component;

reconfiguring the latch member to engage the well component during the second axial component; and locking the latch member in engagement with the well component during the second rotational component.

23. The method according to claim 17, comprising activating a secondary locking arrangement to retain the latch member in engagement with the well component.

24. The method according to claim 17, comprising providing a seal within the well component using a sealing tool supported by the mandrel.

25. A subsea tool system, comprising:

a latch assembly defining a through bore;

a latch member mounted on the latch assembly and being moveable between a latch configuration and an unlatch configuration to facilitate connection and disconnection with a subsea well component;

a mandrel extending through the through bore of the latch assembly, wherein the mandrel and the latch assembly are axially and rotatably moveable relative to each other in a predefined relative movement sequence to operate the latch member and facilitate connection and disconnection with the subsea well component;

a conveyance connector for providing a connection between a conveyance member and the mandrel such that the conveyance member is configured to permit an axial movement portion of the predefined movement sequence;

a rotation interface provided separately from the conveyance connector and mounted on one of the mandrel and the latch assembly such that a subsea manipulator is configured to permit a rotational movement portion of the predefined relative movement sequence;

wherein the rotation interface comprises an engagement arm extending generally radially relative to one of the latch assembly and the mandrel, the engagement arm configured to engage the subsea manipulator to permit torque to be transmitted to one of the latch assembly and the mandrel; and a tool assembly connected to the mandrel.

* * * * *